United States Patent [19]

Hemmann

[11] Patent Number: 4,763,898

[45] Date of Patent: Aug. 16, 1988

[54] COMPETITIVE MANIPULATIVE SKILLS GAME

[75] Inventor: Ronald S. Hemmann, Newington, Conn.

[73] Assignee: Coleco Industries, Inc., West Hartford, Conn.

[21] Appl. No.: 67,279

[22] Filed: Jun. 29, 1987

[51] Int. Cl.[4] ..... A63F 9/00

[52] U.S. Cl. ..... 273/1 GF

[58] Field of Search ..... 273/1 GF, 1 GC; 434/259

[56] References Cited

U.S. PATENT DOCUMENTS

| | | | |
|---|---|---|---|
| 2,659,163 | 11/1953 | Albee | 434/259 X |
| 3,462,154 | 8/1969 | Giraud et al. | 273/135 |
| 3,603,591 | 9/1971 | Shoptaugh | 273/131 AB |
| 3,612,527 | 10/1971 | Rogerson | 273/1 GF X |
| 3,710,455 | 1/1973 | Liversidge et al. | 35/22 A |
| 3,909,003 | 9/1975 | Rabinovich | 273/157 R |
| 3,961,794 | 6/1976 | Goldfarb et al. | 273/132 |
| 3,967,825 | 7/1976 | Anania, Sr. | 273/135 B |
| 4,106,773 | 8/1978 | Coefield | 273/240 |
| 4,149,717 | 4/1979 | Seijiro | 273/1 R |
| 4,451,040 | 5/1984 | Ashley | 273/153 S |

FOREIGN PATENT DOCUMENTS

| | | | |
|---|---|---|---|
| 2641903 | 3/1978 | Fed. Rep. of Germany | 273/1 GF |

*Primary Examiner*—Paul E. Shapiro

[57] ABSTRACT

A game assembly for competitive use employs loose pieces which are configured for selective emplacement upon lowered platforms. When one player succeeds in placing all of his pieces, he may actuate a release mechanism to propel the opponent's platform upwardly, so as to eject the pieces that he has succeeded in placing thereupon. A timer is provided which will automatically effect release of both platforms, in the event that neither player has completed the puzzle during the period of time allotted.

20 Claims, 5 Drawing Sheets

COMPETITIVE MANIPULATIVE SKILLS GAME

BACKGROUND OF THE INVENTION

In Liversidge et al U.S. Pat. No. 3,710,455, an educational game is provided in which shaped pieces are selectively assembled on a form board, subject to a time constraint. The apparatus includes a housing having an upper face with a plurality of apertures of various shapes, into which matching game pieces can be inserted. A spring-impelled discharge plate is provided within the housing, the release of which is controlled by an adjustable timer to dislodge the pieces at the end of a preselected interval.

It is a broad object of the present invention to provide a game of the same general character, but which offers the opportunity for competition between players.

The prior art discloses a considerable variety of manipulative and competitive games and puzzles; the following United States patents are illustrative:

Giraud et al U.S. Pat. No. 3,462,154 provides board game apparatus in which a single playing piece is positioned and concealed in a selected recess of the playing board, and is released to spring upwardly when a device is inserted into an associated opening.

Use of the board game apparatus of Shoptaugh U.S. Pat. No. 3,603,591 involves manipulation of player pieces, and a two-player, area-matching puzzle game is provided by Rabinovich U.S. Pat. No. 3,909,003.

Goldfarb et al U.S. Pat. No. 3,961,794 discloses a motor-skill game which requires the player to work against a timer in manipulating individual game pieces; a competitive game, also involving the manipulation of player pieces, is shown in Anania U.S. Pat. No. 3,967,825, and Coefield U.S. Pat. No. 4,106,773 discloses a competitive crossword puzzle game which utilizes a timer.

Seijiro U.S. Pat. No. 4,149,717 provides a "puzzle box" in which players vie with one another to complete the insertion of blocks through shaped holes within a predetermined period of time, the box being automatically opened by a timer mechanism to designate the end of the game. U.S. Pat. No. 4,451,040, to Ashley, provides a manipulative puzzle-type game utilizing spring-loaded elements.

In addition to the broad object stated above, it is also an object of the present invention to provide a novel competitive game assembly in which means is provided to permit each of the players to stop the timer and thereby avoid automatic ejection of the emplaced pieces.

A more specific object is to provide such a novel assembly which is particularly adapted for use by two players.

Further objects of the invention are to provide a novel game assembly having the foregoing features and advantages, which is uncomplicated to use and is of relatively simple and inexpensive construction.

SUMMARY OF THE INVENTION

It has now been found that certain of the foregoing and related objects of the invention are attained by the provision of a game assembly comprising a housing having placement means adapted for the receipt of a multiplicity of loose pieces in predetermined positions, and for the ejection of such pieces. The placement means comprises first and second ejection members, which are movable independently of one another from lowered positions to elevated positions to effect the discharge of the emplaced pieces. Biasing means is provided for urging the ejection members toward their elevated positions, and latch means is operative to disengageably and separately secure the ejection members in their lowered positions, against the force of the biasing means. Separate manual actuators are operatively connected to the latch means for effecting the release of an associated one of the ejection members, and each actuator includes a contact component that is accessible on the housing for operation by a player. The resettable timer means provided is also operatively connected to the latch means, to simultaneously effect the release of both of the ejection members.

Normally, the ejection members will be disposed in a side-by-side relationship, and the actuator components will be spaced longitudinally from one another on the housing. The housing may, more particularly, have opposite ends on which the actuator contact components are disposed outwardly of the ejection members, with each contact component being spaced to the end of the housing that is opposite to that to which the associated ejection member is adjacent.

In one form, the ejection members will be exposed within the upper portion of the housing and will be adapted for receiving the loose pieces, so that the ejection members alone provide the placement means of the assembly. Each of the ejection members may, more particularly, have a multiplicity of structural elements thereon which are configured distinctively for the engagement of certain of the pieces, so that the assembly will constitute a puzzle that is solved by proper placement of the pieces in engagement with the structural elements.

The latch means will most desirably comprise a pair of elongated shift members, which are mounted in the housing for longitudinal shifting movement between engagement and disengagement positions. Each of the shift members will have an operating element adjacent one end, operatively connected to one of the actuators to enable it to be shifted thereby, and will have a latch element spaced from the operating element for disengageable securement of one of the ejection members in its lowered position. The operating elements and actuators may have cam surfaces and camming elements disposed to coact with one another to effect shifting from their engaged to their disengaged positions.

The timer means will normally comprise a spring motor and will desirably include a part with a drive element that is movable along a first path. In such an instance the latch means will have an engagement element that is disposed along the path of movement of the drive element, to be driven thereby for effecting the release of the ejection members. The shift members will advantageously be mounted to move along parallel axes, and each may have an engagement element thereon which is disposed along the "first" path, for simultaneous interengagement with the drive element of the timer means.

In moving from the engaged to the disengaged position the latch means will normally stop the timer means. The assembly will desirably include a blocking member that can be moved to an interfering position on a second path, along which a second part of the timer means moves, for stopping it. Usually, the blocking member will be manually operable as well as being displaceable to its interfering position by movement of the shift members to their release positions. In one specific form, it will comprise a rocker switch that is pivotably mounted on the housing assembly for manual contact, and the assembly may include a pivotably mounted tilt bar which serves to operatively connect the shift members thereto.

DETAILED DESCRIPTION OF THE ILLUSTRATED EMBODIMENT

Figure 3:
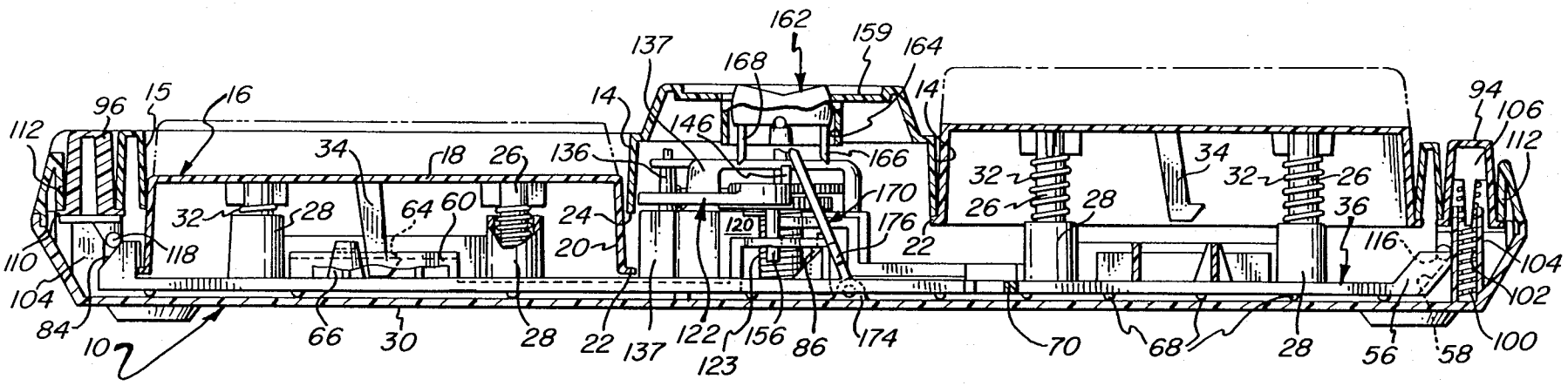
FIG. 3 is a sectional view of the assembly of FIG. 1 with one of the platforms held in its lowered position and the other released, taken approximately along line 3—3 thereof and drawn to the scale of FIG. 2.

Turning now in detail to the appended drawings, therein illustrated is a game assembly embodying the present invention and consisting of a housing, generally designated by the numeral 10, having an upper wall portion 12 which is formed with two square openings 14 defined by downwardly extending peripheral flange elements 15. A square platform, generally designated by the numeral 16, is disposed within each of the openings 14, and consists of a top wall portion 18 and a peripheral skirt portion 20, which has a lip element 22 extending outwardly about its lower end; a hook-like latching element 34 projects downwardly from the top wall portion 18. The platforms 16 are mounted for vertical movement within their respective openings 14; the alternative ultimate positions are shown in FIG. 3, from the right-hand side of which it can be seen that the upper limit of movement is established by abutment of the lip element 22 against the bottom edge 24 of the depending flange 15. Movement of each of the platforms is constrained by the four posts 26 that extend downwardly from its top wall portion 18, the posts being slidably engaged within the tubular formations 28, which project upwardly from the bottom wall portion 30 of the housing 10. Coil spring 32 extend about each of the posts 26 within the associated formations 28, and they bear upon the base portions thereof to urge the platforms 16 upwardly.

Two shift members, generally designated by the numerals 36 and 38, are slidably supported upon the bottom wall 30. The member 36 consists of an elongated rectilinear bar portion 30 having a circular enlargement 42 near one end, within which is formed a keyhole slot 46. A button 48 projects upwardly from the bottom wall 30 of the housing, and serves to slidably engage the bar portion 40 of the member 36 thereunder, the circular part of the slot 46 being of sufficient diameter to permit insertion.

Figure 6:
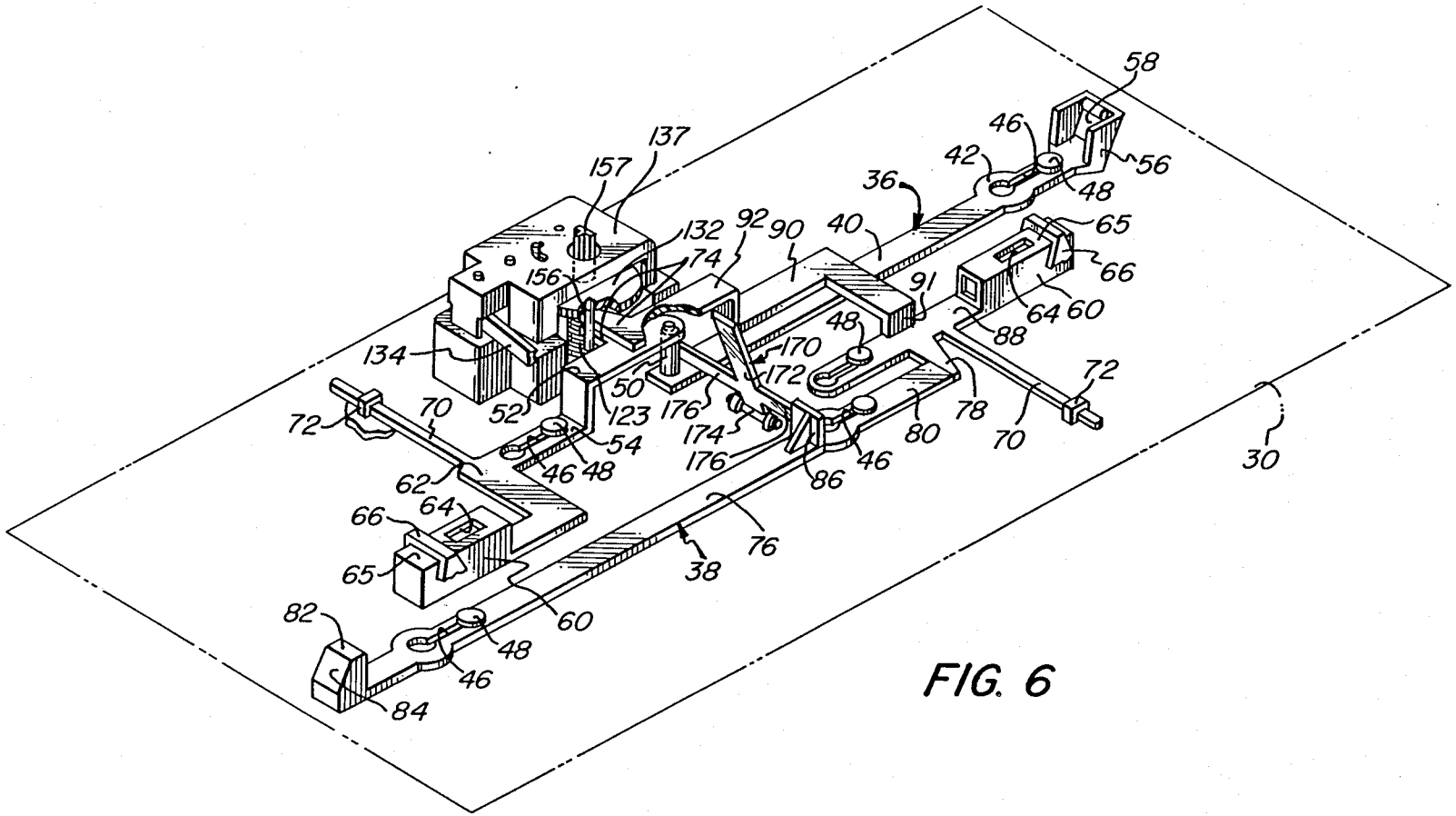
FIG. 6 is a perspective view of the shift bars used for disengageable latching of the receiving platforms, and of associated parts of the timer and timer control components.
Figure 7:
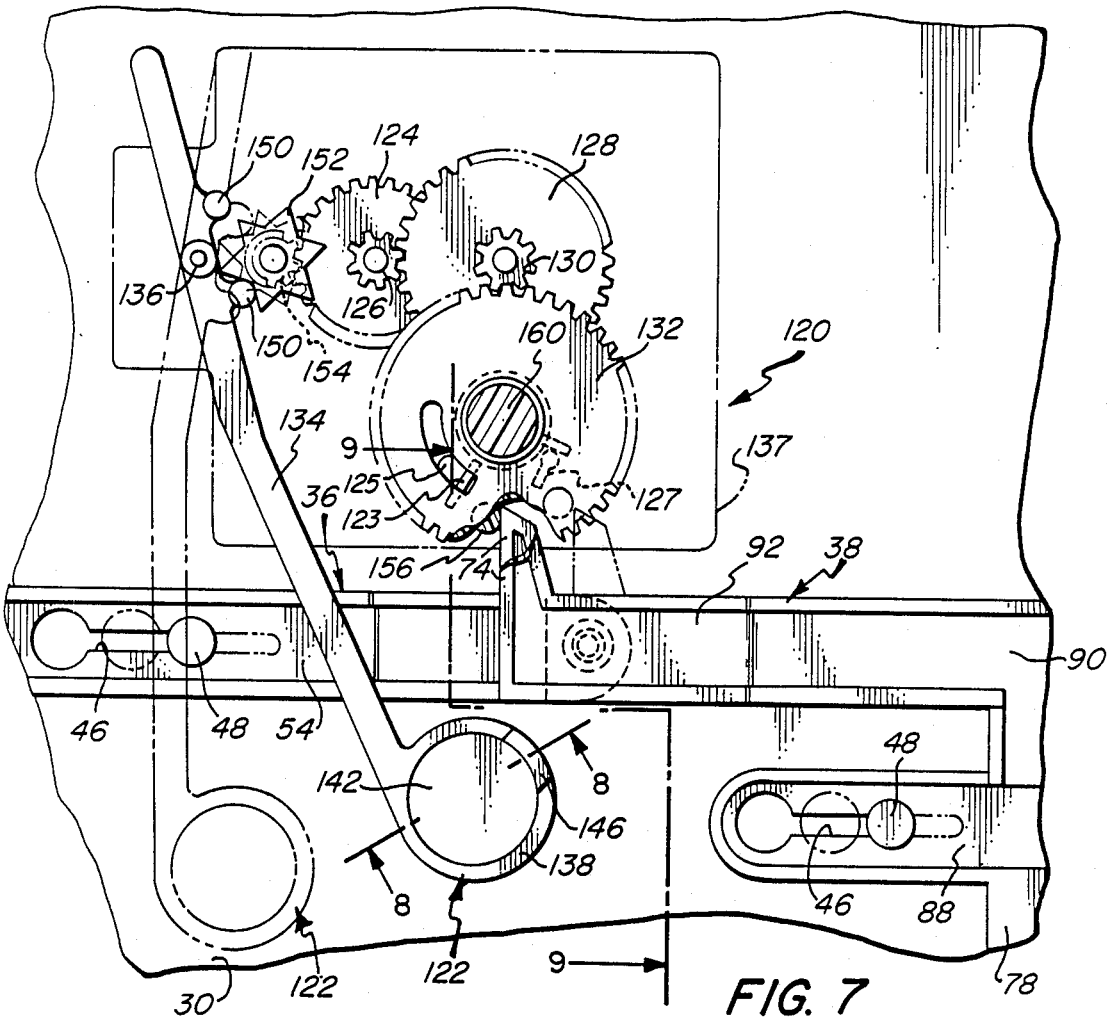
FIG. 7 is a fragmentary plan view of the assembly showing details of the timer and associated parts of the shift bars.
Figure 8:
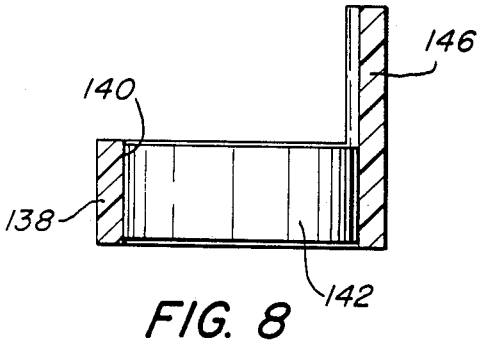
FIG. 8 is a fragmentary sectional view of the head of the timer pendulum, taken along line 8—8 of FIG. 7 and drawn to an enlarged scale.
Figure 9:
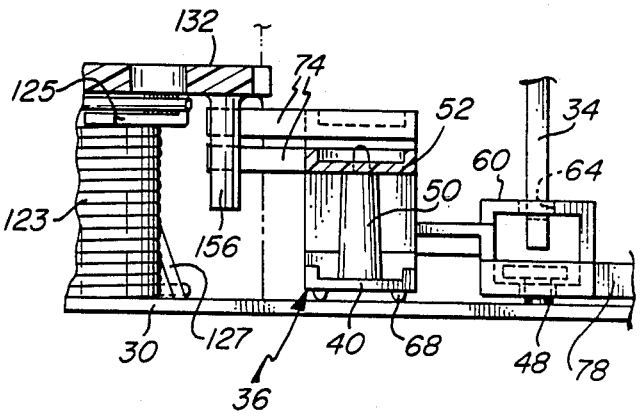
FIG. 9 is a fragmentary sectional view taken along line 9—9 of FIG. 7, showing the interengaging components of the timer mechanism and the latching shift bars.

An upstanding post element 50 attaches the opposite end of the bar portion 40 to the raised element 52 of a right-angle formation, from which a nose element 74 projects laterally. The lower element 54 of the right-angle formation is formed with a keyhole slot 46, which receives the button 48 to thereby slidably engage the corresponding end portion of the member 36 against the lower wall 30, as previously described. A box-like shoe 60 is provided at one extremity of the member 36, and is connected to the lower element 54 by a laterally extending element 62; it has a rectangular slot 64 formed through its top wall portion 65. Channel formation 56, having an inclined wall portion 58, is provided at the opposite extremity of the member 36, and an inverted U-shaped retainer 66 projects upwardly from the bottom wall 30 to slidably receive the shoe 60 to hold the shift member 36 against the bottom wall 30, in cooperation with the buttons 48. Extending laterally from the member 36, in a direction perpendicular to the axis along which it shifts, is a slender branch 70, the free end of which is engaged under the small retaining piece 72, which projects from the surface of the bottom wall portion 30; the branch 70 is resilient, and functions to bias the shift member 36 to a latching position (as illustrated, for example, in FIG. 6). As will be appreciated, a suitably located coil spring, or other biasing means, may be substituted to avoid the possibility of loss of power, due to plastic "creep".

The shift member 38 is similarly constructed and, to the extent that it has common parts, they are given the same numbers; in this instance however the member is comprised of two components. One of them consists of an elongated bar portion 76 having a small angle plate 86 adjacent one end, and having an operating head formation 82, providing an inclined camming surface 84, at the opposite end. The other comprises a bridge-like piece having a laterally extending nose element 78, against which the adjacent end section 80 of the bar portion 76 abuts. The nose element 78 is joined to a short bar portion 88, to the outer end of which is attached the slotted, box-like shoe formation 60. A bi-level stepped structure, comprised of horizontal and vertical right-angle portions 90 and 92, is connected through a short leg 91 to the mid-section of the bar portion 88, and another laterally extending nose element 74 is formed at the end of the section 92.

A pair of actuating push bars 94, 96, of hollow, U-shaped cross section, are seated within elongated slots 98 formed into the upper wall portion 12 of the housing 10 adjacent its opposite end. Coil springs 100, seated within sockets 102 provided by cylindrical housing formations 104, act upon inserts 106 which are secured within the push bars 94 and 96, and peripheral lip formations 110 on the bars cooperate with the lower edges of the internal slot-defining structure 112 of the housing to prevent their upward disassembly.

As seen in FIG. 3, the push bars 94, 96 have cam elements 116, 118 of circular cross section thereupon. The element 116 is disposed within the channel formation 56 on the adjacent end of the shift member 36, for sliding contact upon the inclined wall portion 58 thereof. Similarly, the cam element 118 is disposed to bear upon the camming surface 84 of the head formation 82 on the member 38. As will be appreciated, therefore, downward force upon the push bars 94, 96 will effect the longitudinal shifting of the slide members 36, 38 respectively; it will also be appreciated that both members will be shifted in the same direction under the influence of the force applied.

The hook-like latching elements 34 of the two platforms 16 are aligned with the slots 64 of the underlying shoe formations 60 on the shift members 36 and 38. With the shift members in their normal positions and the platforms lowered, the latching elements 34 enter the slots 64 and engage under the upper wall portions 65 thereabout, to hold the platforms 16 down; as will be noted, the free end portions of the elements 34 are configured to facilitate insertion and latching. Release is effected by applying force to the push bars 94, 96 to shift the corresponding member 36, 38, thereby freeing the engaged hook element and permitting the springs 32 to thrust the platform 16 upwardly.

A timing device is provided within the game housing, and consists of a spring motor providing a resettable wind-up mechanism, generally designated by the numeral 120, and a pendulum generally designated by the numeral 122. The spring motor is of conventional manufacture, and includes a spring 123 wound about a shaft 160, which carries an actuating gear 132; one end of the spring 123 is engaged by a hook-like tab beneath the gear 132, and the other end is engaged behind a lug 127 on the housing wall 30. The gear 132 is in meshing engagement with the smaller pinion portion 130 of a compound gear, the larger pinion portion 128 of which is in meshing engagement with the smaller pinion portion 126 of a second compound gear, the latter being mounted for limited shifting to facilitate winding of the spring 123.

The pendulum 122 includes an arm 136, which is pivotably mounted adjacent one end on a post 136 extending upwardly from the housing 137 of the mechanism 120. A collar-like head portion 138 is provided at one end of the arm 134 and serves to mount a round weight 142, which is press-fit into the circular passage 140 therethrough, and an arcuate section 146 of the collar portion 138 extends above the weight 142 to provide an abutment element. Two cylindrical bosses 150 project from the inner edge of the tail portion of the pendulum arm 134, and are equidistantly spaced to either side of the post 136.

The star-shaped portion 152 of a star gear, which is rotatably mounted adjacent the post 136, extends between the bosses 150, and the pinion portion 154 of the same gear is in meshing engagement with the relatively large pinion portion 124 of the adjacent compound drive gear. As will be appreciated, when the mechanism 120 of the timing device is unwinding it causes the pendulum 122 to pivotally reciprocate on the post 136, due to the alternating engagement of the star wheel portion 152 with the bosses 150, and the rate at which the spring motor unwinds will depend upon the mass of the weight 142, which can be varied for speed control. A circular dial 158 is attached to the T-shaped tang 157 extending from the shaft 160 on which the spring 123 and the actuating gear 132 are mounted, and it is disposed on top of the elevated central panel portion 159 of the upper wall 12 of the housing 10; the dial 158 is graduated in 180 increments, and enables winding of the timing mechanism to afford selectively variable periods of play.

A stud 156 extends downwardly from the actuating gear 132, and is disposed to rotate into contact with the nose elements 74 on the two slide members 36 and 38, which are normally in superimposed alignment with one another. Consequently, upon expiration of the period for which the mechanism 120 has been wound the stud 156 will simultaneously engage both nose elements 74, causing the spring motor to effect shifting of the members 36, 38 from their platform-latching positions to their release positions, and thereby automatically permitting the two platforms 16 to be thrust upwardly by their springs 32 when the allotted time has elapsed.

Figure 5:
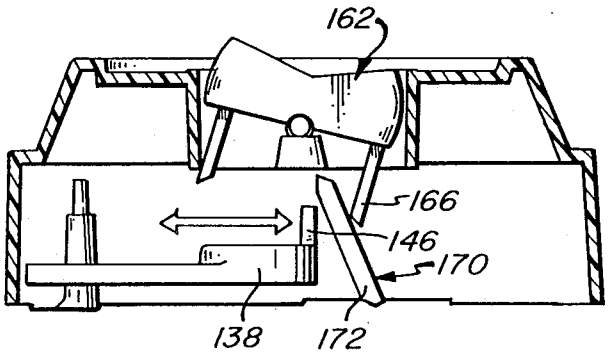
FIG. 5 is a view similar to FIG. 4 showing the control switch in the "on" position.
Figure 4:
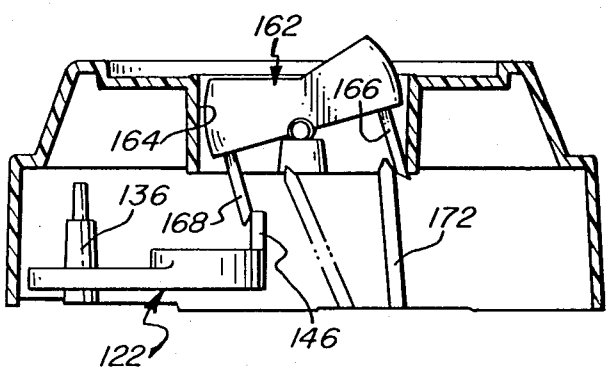
FIG. 4 is a fragmentary sectional view showing the central section of the assembly of the foregoing Figures, with the timer control switch in its "off" position.

The central panel 159 of the housing is formed with a rectangular opening 164, within which a two-position rocker switch 162 is pivotably mounted (its operative positions are shown in FIGS. 4 and 5, FIG. 3 illustrating a transition state). The switch 162 includes a pair of depending legs 166, 168, between which extends the free end portion of the body 172 of a cruciform tilt bar, generally designated by the numeral 170, the base of which is pivotably mounted to the housing wall 30 at 174. Arm portions 176 extend laterally from the opposite sides of the body 172, one being disposed alongside the upstanding angle plate 86 on the slide member 38, and the other being disposed alongside the post 50 on the shift member 36. As a result, movement of either of the shift members 36, 38 toward its release position will cause the tilt bar 172 to pivot from the position of FIGS. 3 and 5 to the full line position of FIG. 4. Contact of the end portion of the body 172 upon the leg 166 will tilt the switch 162 in the opposite direction to bring the other leg 168 into the arcuate path of movement of the upstanding element 146 on the head portion of the pendulum 122. The leg 168 will engage the element 146, thereby arresting the pendulum and in turn stopping the timer by preventing rotation of the star gear 152. Pressing the then elevated element of the rocker switch 162 will of course unblock the pendulum, thereby allowing the timing device to run; obviously, the mechanism can be stopped at any time by manual actuation of the switch 162.

Figures 1, 1A, 1B:
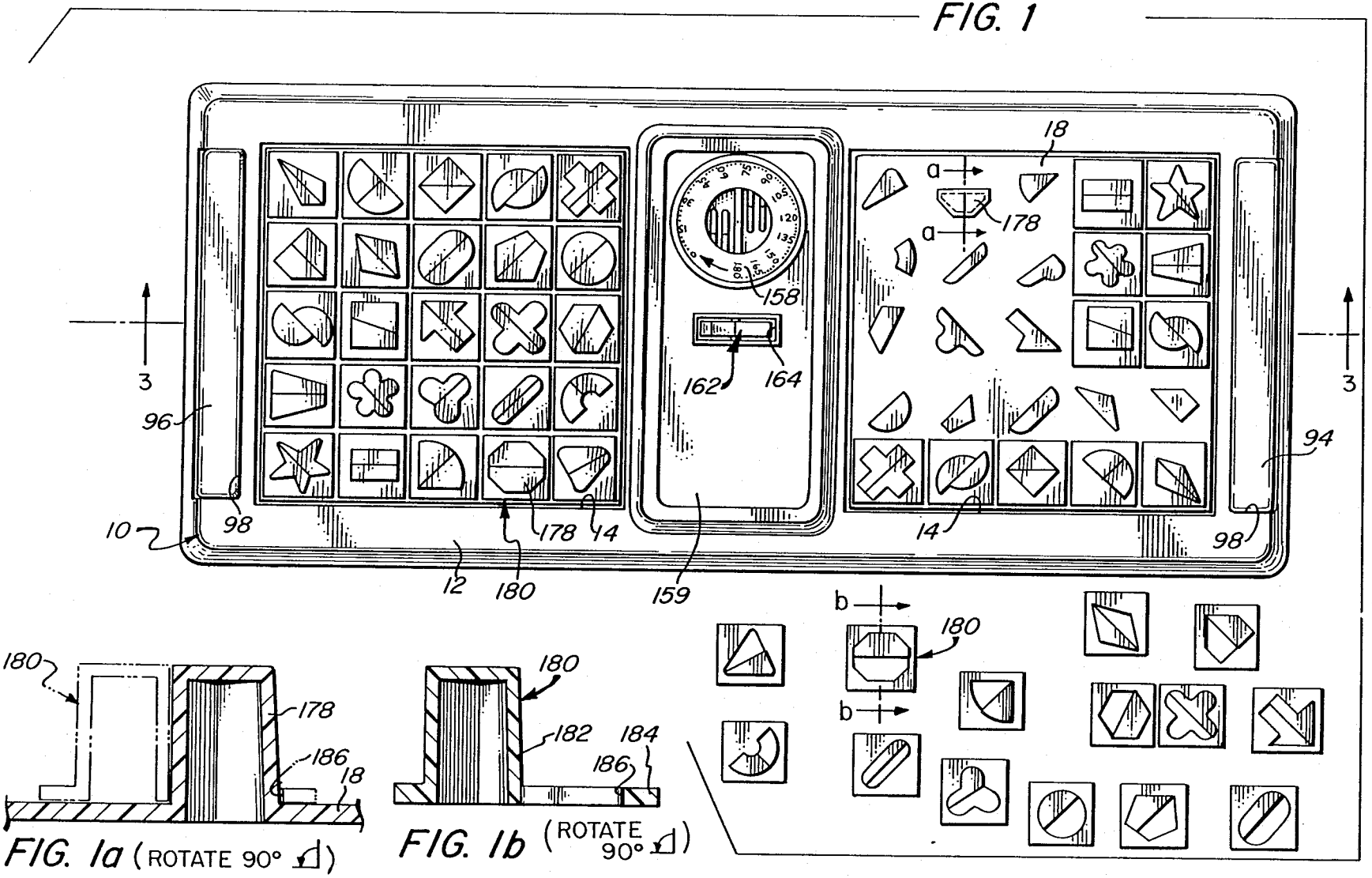
FIG. 1 is a plan view of a game assembly embodying the present invention, showing a multiplicity of loose puzzle pieces emplaced upon the receiving platforms, and the remaining pieces of the set scattered thereabout.
FIG. 1*a* is a fragmentary sectional view, taken along line a—a of FIG. 1 and drawn to a greatly enlarged scale, showing (in phantom line) a mated piece placed upon the corresponding hollow post element of the platform.
FIG. 1*b* is a sectional view of the puzzle piece emplaced upon the post portion of FIG. 1*a*, taken along line b—b of FIG. 1 and drawn to the scale thereof.
Figure 2:
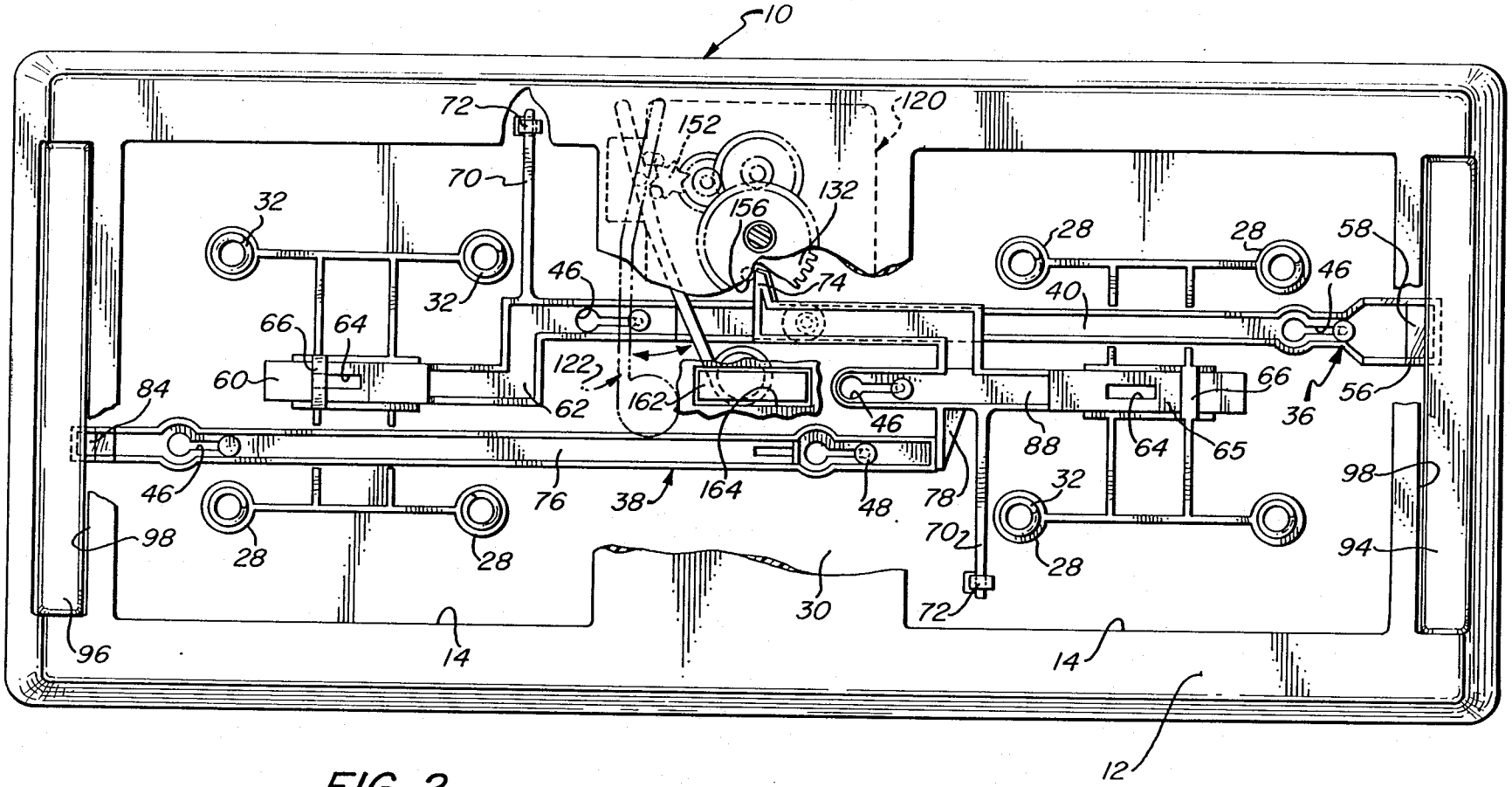
FIG. 2 is a fragmentary plan view of the assembly of FIG. 1, drawn to an enlarged scale and having parts removed to show internal features.

As seen in FIG. 1, the top wall portion 18 of each of the platforms 16 is integrally formed with a number of upstanding, hollow post-like formations of unique cross-sectional configuration, one of which is designated 178 and is shown in vertical section in FIG. 1*a*. Scattered about the unit are a number of puzzle pieces, constructed to correspond to the formations on the wall 18; the piece corresponding to formation 178 is generally designated by the numeral 180. FIG. 1*b* shows the construction of the piece 180, which has an upstanding hollow portion 182, dimensioned and configured to match element 178, and a base portion 184 with a lateral opening 186 shaped to receive the element 178 inserted thereinto; the assembled relationship is shown in FIG. 1*a*. It will be appreciated that each of the pieces (such as 180) is adapted to be inserted upon a particular one of the post formations (such as 178), with the game assembly thereby constituting a puzzle that is solved by properly placing each piece upon the correspondingly configured post. As will be noted, the platform to the left of the housing has the full complement of pieces emplaced thereupon, while that to the right is incomplete in the condition illustrated.

The manner of competitively playing the game of the invention is as follows: With all of the puzzle pieces removed, both of the platforms 16 are depressed and latched in their lowered positions by engagement of the hook-like elements 134 in the corresponding shoe portion 60 of the shift members 36, 38. The timing mechanism is wound by rotation of the dial 158, to establish the period of play, and the rocker switch 162 is set at the position shown in FIG. 5 (if necessary) to unblock the timer and permit it to operate. The players then proceed to place the pieces (e.g., 180) onto the post formations (e g., 178) at their respective ends of the apparatus, and when one of the players succeeds in placing all of his pieces he may press the adjacent bar 94 or 96. Doing so will stop the timer and will effect shifting of the operatively connected shift member 36 or 38, which will in turn release the opponent's platform, causing it to be thrust upwardly and thereby to dislodge all of the loose pieces that he has succeeded in matching with the post formations. For example, the player sitting to the left of the apparatus (as depicted in FIG. 1) would press bar 96, thereby operating the shift member 38 and releasing the platform 16 at the right of the housing. In the event that neither player succeeds in placing all of his pieces before the period of time set by the dial 158 has elapsed, both platforms will simultaneously be released through engagement of the stud 156 with the nose elements 74, thereby ejecting all of the positioned pieces.

As will be appreciated, the specific structure of the assembly of the invention, and of the parts thereof, may vary widely without departing from the concepts hereof. For example, rather than using dynamic platforms which themselves provide the placement means for the loose pieces, separate stationary form boards having openings configured to receive the pieces may be substituted, with the ejection means constituting underlying knock-out members which impact upon the emplaced pieces when released. Also, although a two-player game has been illustrated, it will be understood that the invention is not so limited, and that the construction may be altered to accommodate more players. The selection of the materials of construction will be evident to those skilled in the art, as will the fact that the puzzle pieces employed may take any of a myriad of different forms; these aspects need not therefore be discussed further.

Thus, it can be seen that the present invention provides a novel competitive game in which shaped pieces are selectively assembled on a platform or equivalent structure having means for receiving and ejecting them. Each of the players can stop the timer provided, to thereby avoid automatic ejection of the emplaced pieces, and the assembly is uncomplicated to use and is of relatively simple and inexpensive construction.

Having thus described the invention, what is claimed is:

1. A game assembly for competitive use, comprising:

a housing;

piece placement means in said housing adapted for the receipt of a multiplicity of loose pieces in predetermined positions in association therewith, and for the ejection of such pieces, said placement means comprising at least first and second ejection members that are movable, independently of one another, from lowered positions to elevated positions to effect the ejection of the associated pieces;

biasing means for urging said ejection members toward said elevated positions;

latch means operative to disengageably and separately secure said ejection members in said lowered positions against the force of said biasing means;

a manual actuator associated with each of said ejection members and operatively connected to said latch means for effecting the release of said associated member, each of said actuators including a component accessible on said housing for operation by a player; and resettable timer means operatively connected to said latch means to effect the simultaneous release of both of said ejection members from said lowered positions, to be driven upwardly by said biasing means for dislodgement of the pieces associated therewith.

2. The assembly of claim 1 wherein said first and second ejection members are disposed in side-by-side relationship, and wherein said actuator components are spaced from one another on said housing.

3. The assembly of claim 2 wherein there are only two of said ejection members and said housing has opposite ends on which said actuator components are disposed outwardly of said ejection members, said component of each of said actuators being spaced to the end of said housing opposite to that to which said associated ejection member is adjacent.

4. The assembly of claim 2 wherein said latch means comprises a pair of elongated shift members mounted in said housing for longitudinal shifting movement between engaged and disengaged positions, each of said shift member having an operating element adjacent one end operably connected to one of said actuators to enable shifting thereby, and having a latch element spaced from said operating element for disengageably securing one of said ejection members in its lowered position with said shift member in said engagement position thereof.

5. The assembly of claim 4 wherein said operating elements have cam surfaces thereon, and wherein each of said actuators has a camming element thereon disposed to coact with said cam surface of the operably connected shift member so as to effect shifting from said engaged position to said disengaged position thereof.

6. The assembly of claim 5 wherein said longitudinal shifting movement of said shift members is along parallel axes, and occurs in the same direction in moving from said engaged position to said disengaged position of each.

7. The assembly of claim 4 wherein said timer means has a mechanical action and includes a first movable part with a drive element thereon movable along a first path, and wherein said latch means has at least one engagement element disposed along said first path to be driven by interengagement with said drive element at a certain point to effect such release of said ejection members.

8. The assembly of claim 7 wherein each of said shift members has an element thereon disposed along said first path for simultaneous interengagement with said drive element, to provide said latch means engagement element.

9. The assembly of claim 4 wherein said timer means has a mechanical action and includes a second part that is movable along a second path, and wherein said assembly includes a blocking member that is movable between an interfering position on said second path, for arresting movement of said second part and thereby of said timer means, and a position displaced from said second path to permit said timer means to run.

10. The assembly of claim 9 wherein said blocking member is manually movable between said positions thereof.

11. The assembly of claim 9 wherein said shift members have associated means by which each of them can effect movement of said blocking member from said displaced position to said interfering position during movement of said shift member to said disengaged position thereof.

12. The assembly of claim 11 wherein said blocking member comprises a rocker switch that is pivotably mounted on said housing for manual contact, and wherein said assembly includes a pivotably mounted piece operatively connecting said shift members to said rocker switch.

13. The assembly of claim 1 wherein said ejection members are exposed within the upper portion of said housing and are adapted for receiving such pieces, said members alone providing said placement means.

14. The assembly of claim 13 wherein each of said ejection members has a multiplicity of structural elements thereon configured distinctively for the engagement of certain of the pieces, said assembly constituting a puzzle that is solved by proper placement of the pieces in engagement with said structural elements.

15. The assembly of claim 1 wherein, in moving from said engaged position to said disengaged position, each of said latch means effects the arrestment of said timer means.

16. A game assembly for competitive use, comprising:

a housing having opposite ends;

piece placement means in said housing adapted for the receipt of a multiplicity of loose pieces in predetermined positions in association therewith, and for the ejection of such pieces, said placement means comprising side-by-side first and second ejection members that are movable, independently of one another, from lowered positions to elevated positions to effect the ejection of the associated pieces;

biasing means for urging said ejection members to said elevated positions;

latch means operative to disengageably and separately secure said ejection members in said lowered positions against the force of said biasing means; and a manual actuator associated with each of said ejection members and operatively connected to said latch means for effecting the release of said associated member, each of said actuators including a component accessible on said housing for operation by a player and spaced to the end of said housing opposite to that to which said associated ejection member is adjacent, release of said ejection members from said lowered positions causing them to be driven upwardly by said biasing means for dislodgement of the pieces associated therewith.

17. The assembly of claim 16 wherein said ejection members are exposed within the upper portion of said housing and are adapted for receiving such pieces, said members alone providing said placement means.

18. The assembly of claim 17 wherein each of said ejection members has a multiplicity of structural elements thereon configured distinctively for the engagement of certain of the pieces, said assembly constituting a puzzle that is solved by proper placement of the pieces in engagement with said structural elements.

19. The assembly of claim 16 additionally including resettable timer means, settable to run for a selected period of time and operatively connected to said latch means to effect the simultaneous release of both of said ejection members when the period of time expires.

20. The assembly of claim 16 wherein said latch means comprises a pair of elongated shift members mounted in said housing for longitudinal shifting movement between engaged and disengaged positions, each of said shift member having an operating element adjacent one end operably connected to one of said actuators to enable shifting thereby, and having a latch element spaced from said operating element for disengageably securing one of said ejection members in its lowered position with said shift member in said engagement position thereof, said shifting movement of said shift members being along parallel axes, and in the same direction in moving from said engaged position to said disengaged position thereof.

* * * * *